US011046922B1

(12) United States Patent
Piorkowski et al.

(10) Patent No.: US 11,046,922 B1
(45) Date of Patent: Jun. 29, 2021

(54) 2-IN-1 UNIT DOSE PROVIDING SOFTENING AND DETERGENCY

(71) Applicant: Henkel IP & Holding GmbH, Duesseldorf (DE)

(72) Inventors: Daniel Thomas Piorkowski, Fairfield, CT (US); Holly Ann Robillard, Stratford, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 28 days.

(21) Appl. No.: 16/716,959

(22) Filed: Dec. 17, 2019

(51) Int. Cl.

| | |
|---|---|
| ***C11D 17/00*** | (2006.01) |
| ***C11D 17/04*** | (2006.01) |
| ***C11D 11/00*** | (2006.01) |
| ***C11D 1/835*** | (2006.01) |
| ***C11D 3/00*** | (2006.01) |
| ***C11D 3/34*** | (2006.01) |
| ***C11D 3/37*** | (2006.01) |
| ***C11D 3/20*** | (2006.01) |
| ***C11D 3/12*** | (2006.01) |
| ***C11D 17/06*** | (2006.01) |
| ***B65D 65/46*** | (2006.01) |
| ***C11D 3/10*** | (2006.01) |
| *C11D 1/72* | (2006.01) |
| *C11D 1/22* | (2006.01) |

(52) U.S. Cl.

CPC ..... *C11D 17/046* (2013.01); *B65D 65/46* (2013.01); *C11D 1/835* (2013.01); *C11D 3/001* (2013.01); *C11D 3/10* (2013.01); *C11D 3/1246* (2013.01); *C11D 3/2086* (2013.01); *C11D 3/349* (2013.01); *C11D 3/3715* (2013.01); *C11D 11/0017* (2013.01); *C11D 17/06* (2013.01); *C11D 1/22* (2013.01); *C11D 1/72* (2013.01)

(58) Field of Classification Search

CPC . C11D 11/0017; C11D 17/043; C11D 17/045; C11D 17/042; C11D 17/0039; C11D 17/044; C11D 17/08; C11D 17/04; C11D 17/041; C11D 17/046

See application file for complete search history.

(56) References Cited

U.S. PATENT DOCUMENTS 3,929,678 A 12/1975 Laughlin et al.
3,976,586 A 8/1976 Chakrabarti
(Continued)

OTHER PUBLICATIONS

Pennell, Julie. "This $20 Product Replaced Both My Laundry Detergent and Dryer Sheets." Today, https://www.today.com/shop/we-tried-dreambly-all-one-laundry-sheets-t150960. Accessed Nov. 25, 2019.

(Continued)

*Primary Examiner* — John R Hardee
(74) *Attorney, Agent, or Firm* — Bojuan Deng

(57) ABSTRACT

Provided herein are 2-in-1 unit doses for treating fabrics. The 2-in-1 unit doses include a polyester receptacle coated with a softening agent, and a fabric cleaning agent disposed within the polyester receptacle. The polyester receptacle includes a plurality of pores permeable to liquid such that polyester receptacle allows liquid to diffuse into the cavity through the pores and dissolve the fabric cleaning agent. The 2-in-1 unit doses provide both softening and detergency to fabrics through a wash cycle in a washing machine and a heated dry cycle in a dryer.

20 Claims, 9 Drawing Sheets

(56) References Cited

U.S. PATENT DOCUMENTS

| | | | | |
|---|---|---|---|---|
| 4,740,326 | A * | 4/1988 | Hortel | C11D 3/225 510/295 |
| RE33,646 | E * | 7/1991 | Klemm | C11D 3/001 510/277 |
| 5,545,342 | A * | 8/1996 | Beagle | C11D 3/0036 510/297 |
| 5,945,394 | A | 8/1999 | Sajic et al. | |
| 6,024,943 | A | 2/2000 | Ness et al. | |
| 6,046,149 | A | 4/2000 | Sorrie et al. | |
| 6,056,949 | A | 5/2000 | Menzi et al. | |
| 6,194,375 | B1 | 2/2001 | Ness et al. | |
| 6,458,754 | B1 | 10/2002 | Velazquez et al. | |
| 7,456,145 | B2 | 11/2008 | Lentsch et al. | |
| 8,426,353 | B2 | 4/2013 | Ouali et al. | |
| 2004/0235705 | A1 * | 11/2004 | Popplewell | C11D 3/37 510/515 |
| 2011/0224127 | A1 | 9/2011 | Blyth et al. | |

OTHER PUBLICATIONS

"Dreambly Wash+Dry Sheets (40ct)." Dreambly, https://dreambly.com/products/dreambly. Accessed Nov. 25, 2019.

* cited by examiner

2-IN-1 UNIT DOSE PROVIDING SOFTENING AND DETERGENCY

FIELD OF THE INVENTION

The present disclosure relates to 2-in-1 unit doses for treating fabrics. More specifically, the present disclosure relates to unit doses having a polyester receptacle and a fabric cleaning agent disposed within the polyester receptacle, which provides both softening and detergency to fabrics through a wash cycle in a washing machine and a heated dry cycle in a dryer.

BACKGROUND OF THE INVENTION

Current laundry cleaning methods that include a laundry detergent and a fabric softener require the consumer to perform at least two steps: (1) adding detergent to the washing machine at the start of a washing cycle; and (2) adding liquid fabric softener to the washing machine during a rinse cycle. Laundry detergents and fabric softeners are typically added separately because the negatively charged detergents (anionic surfactants) must be fully solubilized by the water in the washing machine before the positively charged liquid fabric softeners, (cationic surfactants, e.g., quarternary ammonium compounds) are added. The anionic surfactants must be added to the wash, given time to clean the textiles, and then rinsed off the fabrics and drained from the washing machine prior to the cationic softeners being added. If the anionic and cationic ingredients are added to the wash cycle at the same time, they combine to form a solid precipitate, and accordingly, do not provide cleaning and/or softening to the fabrics in the washing machine. Furthermore, if the consumer desires a level of softness that is additional to the level provided by the rinse-cycle fabric softener, the laundry cleaning method can require a third step: (3) adding a fabric softening article to the dryer, for example, a dryer sheet. Such laundry cleaning methods can be inconvenient to the consumer, who must schedule the laundry cleaning method such that the liquid fabric softener is added at the correct time during the washing cycle. Additionally, consumers can find it burdensome to carry large containers of liquid laundry detergents and/or liquid fabric softeners.

To address this issue, unit doses containing laundry detergents (i.e., "pods") were designed as an alternative to using large containers of liquids. Some unit doses contained liquid detergents, which include active and inactive liquids such as water and solvents. Shipping large quantities of inactive liquids requires large amounts of oil and gas, which wastes energy and increases shipping costs. Other unit doses were designed to contain powder detergents. The powder detergents are lighter and therefore require lower shipping weights, providing a more ecologically sustainable and cost-efficient detergent option to consumers.

However, the powder detergent unit doses also suffer from drawbacks. For example, the polyvinylalcohol (PVA) film that is used to encapsulate the detergent provides no benefit to the laundry cleaning method or to the consumer. Additionally, in some cases the PVA film does not completely solubilize, leaving the consumer with PVA films left inside the washing machine, or worse, a still-encapsulated, partly solubilized powder unit dose inside the washing machine and on the wet laundry. Another drawback to currently available unit doses is that the consumer still needs to add a separate softening agent, for example, a dryer sheet, to the dryer, if the consumer desires additional softening.

Accordingly, a need exists for a unit dose that provides convenient, ecologically sustainable, and cost-effective delivery of detergency and softening to laundered fabrics.

BRIEF SUMMARY OF THE INVENTION

In some aspects, the present disclosure provides a unit dose having a polyester receptacle enclosing a cavity and a fabric cleaning agent disposed within the cavity of the polyester receptacle. In some aspects, the polyester receptacle includes a plurality of pores permeable to liquid such that polyester receptacle allows liquid to diffuse into the cavity through the pores and dissolve the fabric cleaning agent.

In some aspects, the polyester receptacle has an interior surface which forms the cavity, and an exterior surface. In some aspects, the interior surface is in contact with the fabric cleaning agent.

In some aspects, the polyester receptacle includes an adhesive binding which seals the polyester receptacle, such that the fabric cleaning agent disposed within the cavity is bound within the polyester receptacle. In some aspects, the polyester receptacle is configured such that the fabric cleaning agent dissolves within the polyester receptacle during a wash cycle in a washing machine, and the emptied cavity remains sealed throughout the duration of the wash cycle.

In some aspects, the polyester receptacle includes a plurality of liquid-soluble stitches which releasably seal the cavity, such that the polyester receptacle is configured to unseal and release the fabric cleaning agent when immersed in liquid.

In some aspects, the polyester receptacle is spherical-shaped. In some aspects, the polyester receptacle is cubical-shaped. In some aspects, the polyester receptacle is polyhedral-shaped. In some aspects, the polyester receptacle is sack-shaped.

In some aspects, the polyester receptacle is configured to enclose from about 5 grams to about 100 grams of the fabric cleaning agent within the cavity, and a portion of the polyester receptacle is free of the fabric cleaning agent. In some aspects the polyester receptacle is configured to enclose from about 5 grams to about 100 grams, or from about 5 grams to about 80 grams, or from about 10 grams to about 80 grams, or from about 10 grams to about 75 grams, or from about 10 grams to about 50 grams, or about 10 grams, or about 20 grams, or about 30 grams, or about 40 grams, or about 50 grams of the fabric cleaning agent within the cavity, and a portion of the polyester receptacle is free of the fabric cleaning agent.

In some aspects, the plurality of pores have a transverse dimension of a size that is configured to enclose a fabric cleaning agent having a particle size that is larger than about 50 microns, such that the fabric cleaning agent does not escape through the plurality of pores. In some aspects, the plurality of pores each have a transverse dimension of from about 20 microns to about 60 microns.

In some aspects, the polyester receptacle is coated with a softening agent. In some aspects, the softening agent adheres to the polyester receptacle throughout a wash cycle in a washing machine. In some aspects, the exterior surface of the polyester receptacle is coated with the softening agent. In some aspects, the exterior surface and the interior surface of the polyester receptacle are coated with the softening agent.

In some aspects, the softening agent includes a quaternary ammonium compound. In some aspects, the quaternary ammonium compound is selected from the group consisting of: alkylated quaternary ammonium compounds, ring or cyclic quaternary ammonium compounds, aromatic quaternary ammonium compounds, diquatemary ammonium compounds, alkoxylated quaternary ammonium compounds, amidoamine quaternary ammonium compounds, ester quaternary ammonium compounds, and mixtures thereof. In some aspects, the softening agent can be diethyloxyester dimethyl ammonium chloride (DEEDMAC) and/or methyl bis[ethyl (tallowate)]-2-hydroxyethyl ammonium methyl sulfate. In some aspects, the softening agent is present in the coating of the polyester receptacle in an amount of from about 35 to 80% by a combined weight of the polyester receptacle and the softening agent.

In some aspects, the softening agent has a melting point of from about 80° F. to about 160° F. In some aspects, the softening agent has a melting point of from about 110° F. to about 150° F. In some aspects, the softening agent has a melting point of about 80° F. In some aspects, the softening agent has a melting point of about 100° F. In some aspects, the softening agent has a melting point of about 110° F. In some aspects, the softening agent has a melting point of about 120° F. In some aspects, the softening agent has a melting point of about 150° F.

In some aspects, the fabric cleaning agent includes a solid particulate detergent. In some aspects, the fabric cleaning agent comprises a surfactant system, sodium carbonate, sodium percarbonate, citric acid, sodium silicate, or any combination thereof. In some aspects, the surfactant system comprises sodium alkyl benzene sulphate and alcohol ethoxylate. In some aspects, the fabric cleaning agent comprises sodium carbonate, sodium percarbonate, sodium alkyl benzene sulphate, C13-15 alcohol ethoxylate (5EO), citric acid anhydrous, C12/13-15 alcohol ethoxylate (7EO), and sodium silicate, or any combination thereof.

In some aspects, the fabric cleaning agent has a particle size of from about 50 microns to about 5000 microns, or from about 60 microns to about 4000 microns, or from about 70 microns to about 3500 microns.

In some aspects, the fabric cleaning agent includes a fragrance and/or a dye transfer inhibitor.

In some aspects, the fragrance is a neat fragrance (i.e., a free oil), or an encapsulated fragrance (e.g. melamine-formaldehyde encapsulates). In some aspects, the fragrance can be present in an amount of from about 0.1% to about 10%, or from about 0.5 wt % to about 10.0 wt %, or from about 0.5 wt % to about 8.0 wt %, or from about 0.5 wt % to about 7.5 wt %, or from about 0.5 wt % to about 5.0 wt %, based on the total weight of the fabric cleaning agent.

In some aspects, the fabric cleaning agent further includes at least one additional agent selected from the group consisting of: an anti-wrinkling agent, an odor capturing agent, a fiber protection agent, a color protection agent, a soil releasing agent, an anti-redeposition agent, an optical brightening agent, a UV protection agent, an anti-pilling agent, a water repellency agent, a disinfecting and/or sanitizing agent, a souring agent, a repellent, and mixtures thereof. In some aspects, the unit dose includes at least one additional agent in an amount of from about 0.1 to about 5% based on the total weight of the fabric cleaning agent.

In some aspects, the present disclosure provides a kit containing one or more unit doses, wherein each unit dose includes: a polyester receptacle enclosing a cavity, wherein a solid fabric cleaning agent is disposed within the cavity of the polyester receptacle. In some aspects, the polyester receptacle is sealed with an adhesive binding. In some aspects, the polyester receptacle is sealed with liquid-soluble stitches. In some aspects, the kit includes instructions for use.

In some aspects, the present disclosure provides a method of making a unit dose for treating fabrics in a washing machine and dryer, including: providing a polyester receptacle having a plurality of pores that are permeable to liquid such that the polyester receptacle allows liquid to diffuse into and out of the cavity, wherein the polyester receptable is coated with a softening agent; shaping the polyester receptable to define a cavity; disposing a solid fabric treatment agent within the cavity of the polyester receptacle; and sealing the polyester receptacle to enclose the solid fabric treatment agent. In some aspects, the sealing step is conducted by use of a plurality of liquid-soluble stitches to releasably seal the cavity, such that the polyester receptacle is configured to unseal and release the fabric cleaning agent when immersed in liquid.

In some aspects, the present disclosure provides a method for treating one or more fabrics in a washing machine and a dryer, including: (i) disposing the unit dose polyester receptacle and fabrics to be cleaned in the washing machine, (ii) setting the washing machine on a wash cycle to immerse the fabrics and the unit dose in liquid and wash the fabrics, wherein during the wash cycle the fabric cleaning agent is dissolved and carried out of the cavity for cleaning the fabrics, (iii) removing the fabrics with the polyester receptacle from the washing machine; (iv) disposing the fabrics and the polyester receptacle into a dryer; and (v) setting the dryer on a heated drying cycle to apply heat to the fabrics with the polyester receptacle, wherein during the drying cycle the softening agent is consumed for providing a softening effect onto the fabrics.

DETAILED DESCRIPTION OF THE INVENTION

Definitions

Figure 1:
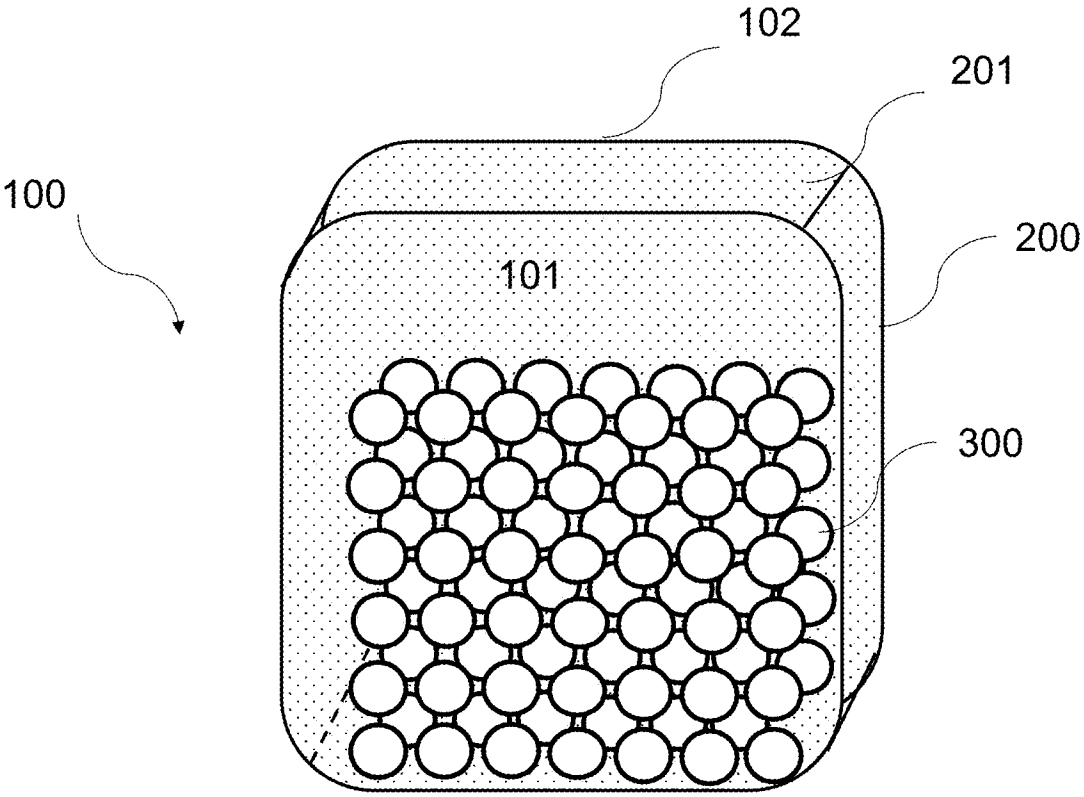
FIG. 1 illustrates a unit dose, according to an embodiment.

All of the various aspects, aspects, and options disclosed herein can be combined in any and all variants unless otherwise specified. Terms in this application control in the event of a conflict with a patent or publication term that is incorporated by reference.

As used herein, "a," "an," or "the" means one or more unless otherwise specified.

Open terms such as "include," "including," "contain," "containing," and the like mean "comprising."

The act of treating a laundry (e.g., fabric) can refer to, for example, one or more of: i) cleaning a fabric, ii) softening a fabric; iii) applying fragrance to a fabric; iv) rendering a fabric resistant to static build up during drying, (v) applying a color protection agent to a fabric, (vi) applying an anti-wrinkling agent to a fabric, (vii) applying an odor capturing agent to a fabric, (viii) applying a fiber protection agent to a fabric, (ix) applying a soil releasing agent to a fabric, (x) applying an optical brightening agent to a fabric, (xi) applying a UV protection agent to a fabric, (xii) applying an anti-pilling agent to a fabric, (xii) applying a water repellency agent to a fabric, (xiii) applying a disinfecting and/or sanitizing agent to a fabric, (xiv) applying a souring agent to a fabric, (xv) applying a repellent to a fabric, and any combination thereof.

Some aspects contemplate numerical ranges. Numerical ranges provided herein include the range endpoints as individual aspects. When a numerical range is provided, all individual values and sub-ranges therein are present as if explicitly provided.

The terms "laundry," "textile," and "fabric" can be used interchangeably.

The terms "fragrance" and "perfume" can be used interchangeably.

The term "about" is synonymous with the term "approximately," and includes the recited number ±10% or ±5%. For example, "about 10" means 9 to 11. Also as an example, a temperature of approximately 50° C. means 45-55° C., or 47.5° C.-52.5° C. Unless indicated otherwise, all percentages indicated are percentage by weight.

The term "at least one," refers to one or more, for example 1, 2, 3, 4, 5, 6, 7, 8, 9 or more. In particular, this information refers to the type of agent/compound and not to the absolute number of molecules. "At least one fragrance" therefore means that at least one type of fragrance is included, but that two or more different types of fragrances can also be included.

The terms "unit dose" and "unit dose article" can be used interchangeably.

The terms "wash cycle" and "washing cycle" can be used interchangeably. The terms "wash cycle" and "washing cycle" refer to one cycle of washing and rinsing a load of laundry in a top or front loading consumer washing machine, which takes place after a consumer sets the washing machine to "on," which immerses the laundry in water.

Aspects

Aspects of the present disclosure are described in detail with reference to aspects thereof as illustrated in the accompanying drawings. References to "one embodiment," "an embodiment," "some aspects," etc., indicate that the embodiment(s) described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other aspects whether or not explicitly described.

The following examples are illustrative, but not limiting, of the present aspects. Other suitable modifications and adaptations of the variety of conditions and parameters normally encountered in the field, and which would be apparent to those skilled in the art, are within the spirit and scope of the disclosure.

Unit Dose Article

As described herein, there is a need for an article that provides benefits to laundry fabrics for use in a washing machine and a dryer. The 2-in-1 article described herein, and the various aspects thereof described herein, provides a simple and ecological way to impart detergency to fabrics during a wash cycle in a washing machine, and impart softness to the fabrics during a drying cycle in a dryer, without wasting materials. Furthermore, a number of additional benefits can be provided to laundry via the 2-in-1 unit dose articles described herein.

Figure 2:
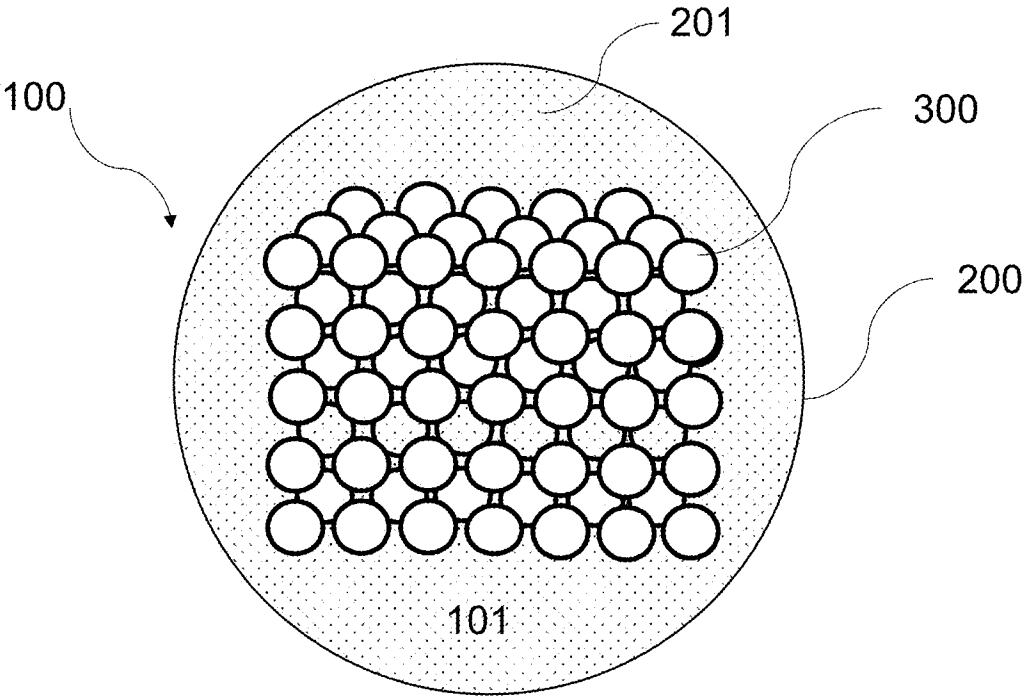
FIG. 2 illustrates a unit dose, according to an embodiment.
Figure 3:
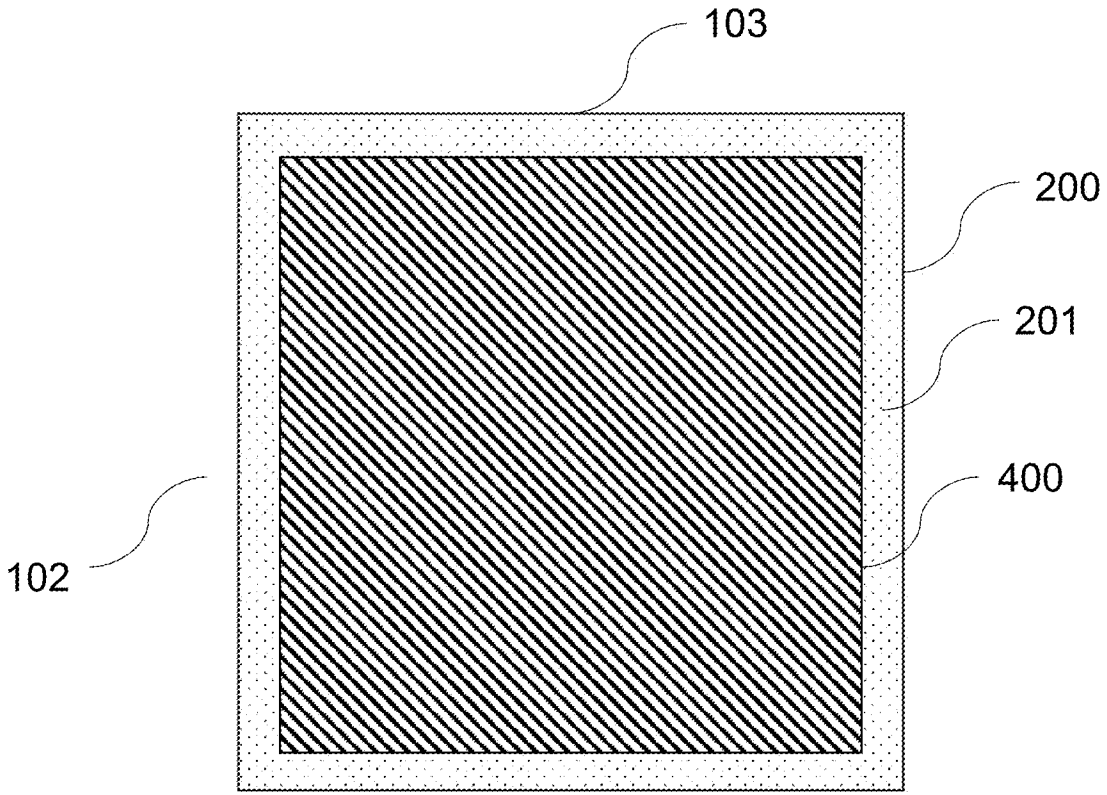
FIG. 3 illustrates a polyester sheet, according to an embodiment.

Aspects of the disclosure will now be described in more detail with reference to the Figures. With reference to FIGS. 1-3, in some aspects, as shown, the device includes a unit dose 100. In some aspects, the unit dose 100 comprises a polyester receptacle 200, enclosing a cavity 101, and a fabric cleaning agent 300 disposed within the cavity 101 of the polyester receptacle 200. As further shown, the polyester receptacle 200 can include a plurality of pores 201 configured to allow liquid to permeate through such that polyester receptacle 200 allows liquid to diffuse into the cavity 101 and dissolve the fabric cleaning agent 300. In some aspects, the plurality of pores 201 have a transverse dimension (e.g., diameter) that is configured to impede the fabric cleaning agent 300 from passing through the pores 201 such that the fabric cleaning agent 300 is contained within the cavity 101. In some aspects, the fabric cleaning agent 300 comprises a granular material having a particle size that is larger than about 50 microns. In some aspects, the plurality of pores 201 each comprise a transverse dimension in a range from about 20 microns to about 100 microns, such as from about 30 microns to about 50 microns, to prevent the fabric cleaning agent 300 from escaping through the pores 201. In some aspects, the fabric cleaning agent has a particle size of from about 50 microns to about 5000 microns, or from about 60 microns to about 4000 microns, or from about 70 microns to about 3500 microns.

Figure 6:
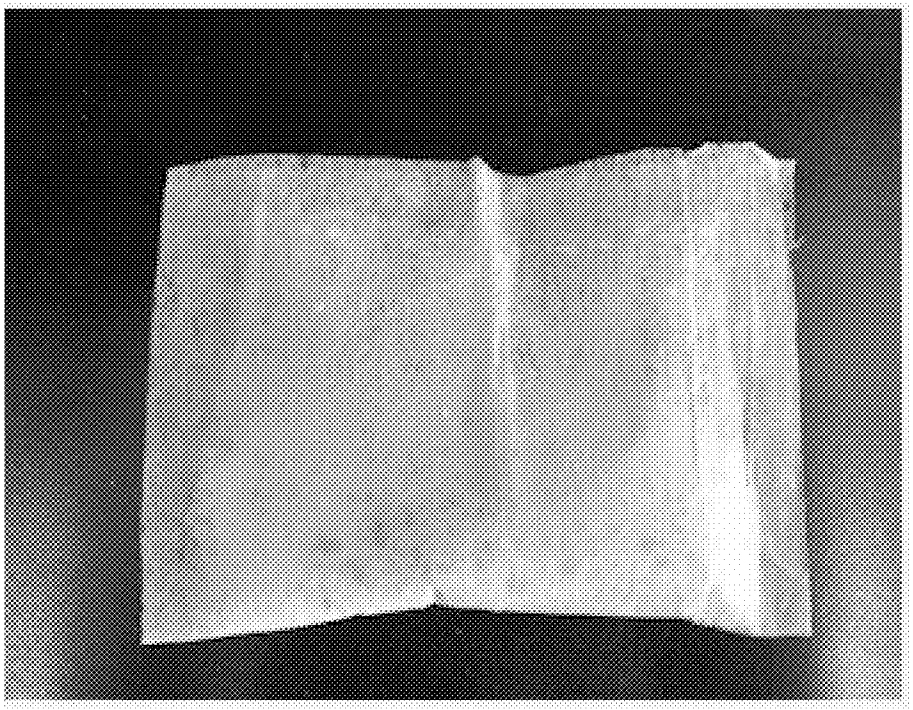
FIG. 6 shows a unit dose containing a solid particulate fabric cleaning agent, according to an embodiment.

In some aspects, the polyester receptacle 200 includes an interior surface defining the outer boundary of cavity 101, and an exterior surface 102. As shown, in some aspects, the interior surface 102 can be in contact with the fabric cleaning agent 300. The polyester receptacle 200 can be adapted to define different shapes and sizes so that the volume of cavity 101 is configured to hold a predetermined amount of the fabric cleaning agent 300. For example, as shown in FIG. 1, in some aspects, the polyester receptacle 200 is cubical-shaped. The shape need not be an exact cube, for example, edges can be rounded or sides can be different sizes. In some aspects, as shown in FIG. 2, for example, the polyester receptacle 200 is spherical-shaped. In some aspects, the polyester receptacle 200 is polyhedral-shaped. As shown in FIG. 6, in some aspects, the polyester receptacle 200 is sack-shaped. In various aspects, the shape and size of polyester receptacle 200 can be modified to adjust the amount of fabric cleaning agent 300 held in the cavity 101 and the porous surface area of the polyester receptacle 200 for diffusing fluid into the cavity 101. For example, in some aspects, the polyester receptacle 200 can have a thickness such that when laid on a flat surface, the polyester receptacle 200 appears to have a planar shape (e.g., circular, oval, rectangular, square, etc.).

The polyester receptacle 200 can be formed by any suitable process, such as, for example, molding, casting, extruding, or blowing. In some aspects, the polyester receptacle 200 can be formed by extruding a sheet of the polyester material into the predetermined shape (e.g., cubical, spherical, sack-shaped) and then applying adhesive binding to the sheet to seal the polyester receptacle 200. In certain aspects, the adhesive binding is liquid insoluble such that the polyester receptacle 200 continues to enclose the cavity 101 when immersed in liquid. In some aspects, the polyester receptacle 200 can be formed by extruding a sheet of the polyester material into the predetermined shape (e.g., cubical, spherical, sack-shaped) and then securing the intersected portions of the sheet via stiches to seal the polyester receptacle 200. In some aspects, the stitches are liquid soluble such that polyester receptacle 200 is configured to unseal and release the fabric cleaning agent 300 when immersed in liquid. In some aspects, the polyester receptacle 200 can be formed by folding a sheet of polyester material and sealing the edges (e.g., with an adhesive, stitching, etc.), with the fabric cleaning agent 300 disposed inside.

As shown in FIG. 1 and FIG. 2, in some aspects, the unit dose 100, comprising the polyester receptacle 200 is configured to enclose a mass of fabric cleaning agent 300 within the cavity 101, with a portion of the cavity 101 of the polyester receptacle 200 free of the fabric cleaning agent. That is, there can be a portion of the volume of the cavity 101 that is not filled with the fabric cleaning agent 300.

As shown in FIG. 3, in some aspects, the polyester receptacle 200 having a plurality of pores 201 is coated with a softening agent 400. In some aspects, the exterior surface 102 and the interior surface 103 of the polyester receptacle 200 are coated with the softening agent 400. In some aspects, only one of the exterior or interior surfaces of the polyester receptacle 200 is coated with the softening agent 400. All or only a portion of the interior and/or exterior surfaces can be coated with the softening agent 400.

Figure 4A:
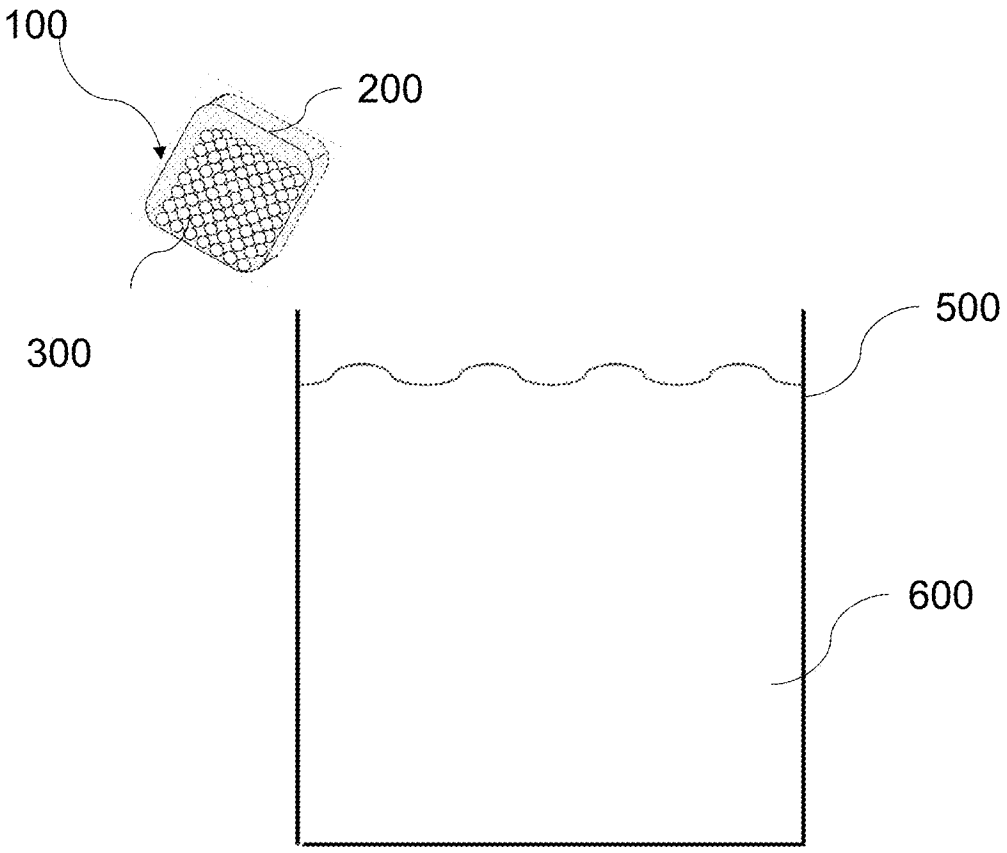
FIG. 4A illustrates a unit dose prior to being disposed in a washing machine, according to an embodiment.
Figure 4B:
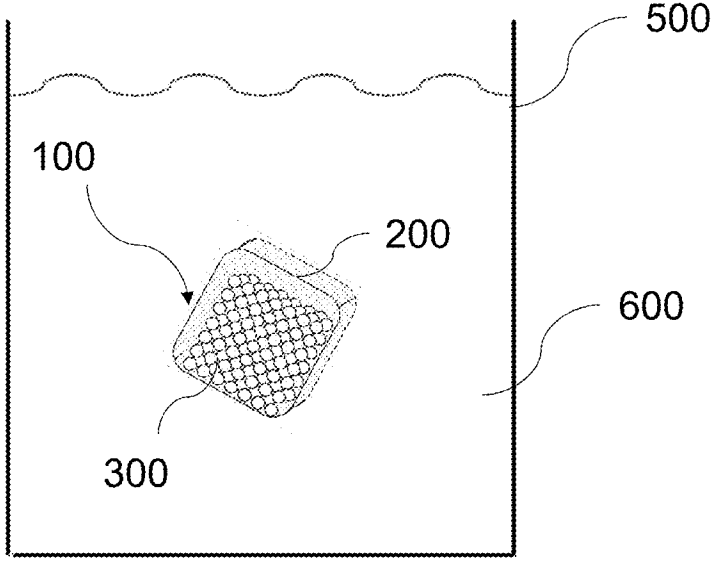
FIG. 4B illustrates a unit dose disposed in liquid in a washing machine, according to an embodiment.
Figure 4C:
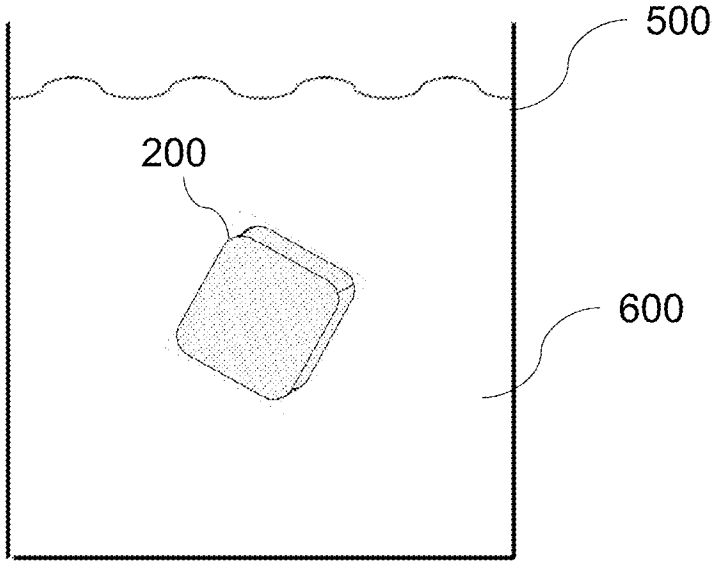
FIG. 4C illustrates a unit dose after the fabric cleaning agent is dissolved and the polyester receptacle is empty, according to an embodiment.
Figure 4D:
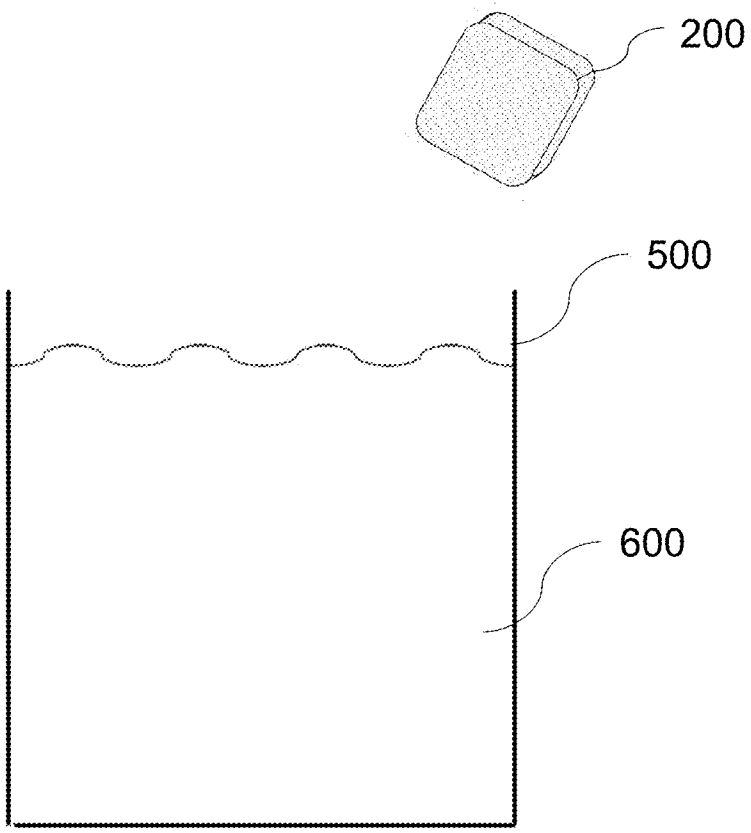
FIG. 4D illustrates a unit dose after treating laundry in a washing machine, according to an embodiment.

FIGS. 4A-4D show a method of using the unit dose 100 according to aspects. As shown in FIG. 4A, in some aspects, the methods described herein comprise treating one or more fabrics in a washing machine by inserting a unit dose 100 into a drum of a washing machine 500 filled with washing liquid 600. The polyester receptacle 200 containing the solid fabric cleaning agent 300, is permeable to the washing liquor 600. As shown in FIG. 4B and FIG. 4C, in some aspects, a unit dose 100 is immersed in the washing liquor 600 in the washing machine 500, such that the washing liquor 600 can diffuse into the polyester receptacle 200 and dissolve the fabric cleaning agent 300. In some aspects, the methods disclosed herein comprise setting the washing machine 500 on a wash cycle to immerse the one or more fabrics and the unit dose in liquid 600. As shown in FIG. 4D, in some aspects, the methods disclosed herein comprise removing the empty polyester receptacle 200 from the washing machine 500 and disposing the one or more fabrics with the polyester receptacle into a dryer drum of the dryer; and setting the dryer on a heated drying cycle to apply heat to the one or more fabrics with the polyester receptacle 200.

In some aspects, the unit dose 100 is suitable for use in a cold water washing cycle, a warm water washing cycle, and/or a hot water washing cycle. Every manner of washing machine and dryers are contemplated for use with the unit dose of the present disclosure.

As described elsewhere herein, in some aspects, the polyester receptacle 200 having a plurality of pores 201 is coated with a softening agent 400.

In some aspects, the softening agent comprises a quaternary ammonium compound. In some aspects, the quaternary ammonium compound is selected from the group consisting of: alkylated quaternary ammonium compounds, ring or cyclic quaternary ammonium compounds, aromatic quaternary ammonium compounds, diquatemary ammonium compounds, alkoxylated quaternary ammonium compounds, amidoamine quaternary ammonium compounds, ester quaternary ammonium compounds, and mixtures thereof. In some aspects, the softening agent can be diethyloxyester dimethyl ammonium chloride (DEEDMAC) and/or methyl bis[ethyl (tallowate)]-2-hydroxyethyl ammonium methyl sulfate.

In some aspects, the softening agent is coated on the polyester receptacle. In some aspects, the softening agent is present in the coating of the polyester receptacle in an amount of from about 35 to 80%, by a combined weight of the polyester receptacle and the softening agent.

In some aspects, the softening agent adheres to the polyester receptacle throughout a wash cycle in a washing machine. This provides the advantage of allowing for a one-step method for cleaning and softening laundry. Without being bound by theory, it is thought that because the melting point of the softening agent is higher than the temperature of the washing liquid inside the washing machine, the softening agent does not melt, diffuse, release, etc. from the polyester receptacle during the course of the washing cycle in the washing machine. Instead, the softening agent advantageously adheres to the polyester receptacle during the washing cycle, and is thus available as a softening agent for the same washed fabrics as they are removed (as clean, wet, laundry) from the washing machine and inserted into the dryer. This one-step method eliminates a need for the consumer to either (1) insert a softening agent into the washing machine during a rinse cycle, and/or (2) separately insert a fabric softening sheet into the dryer. This one-step method further eliminates any non-functional items, for example, PVA films, thereby reducing waste and inactive material.

In some aspects, the softening agent has a melting point of from about 80° F. to about 160° F. In some aspects, the unit dose article of the present disclosure is suitable for a cold-water washing cycle in a washing machine. In some aspects, the softening agent has a melting point of about 80° F. In some aspects, the unit dose article of the present disclosure is suitable for a warm-water washing cycle in a washing machine. In some aspects, the softening agent has a melting point of about 100° F. In some aspects, the softening agent has a melting point of about 110° F. In some aspects, the unit dose article of the present disclosure is suitable for a hot-water washing cycle in a washing machine. In some aspects, the softening agent has a melting point of about 120° F. In some aspects, the softening agent has a melting point of about 150° F. In some aspects, the softening agent has a melting point of about 160° F.

Fabric Cleaning Agent

The fabric cleaning agent described herein is a solid agent contained within the unit dose article that can be used, for example, in the washing cycle of a laundry or fabric cleaning method to provide cleaning, detergency, and/or other benefits to fabrics. Other benefits include, but are not limited to fragrance, dye transfer inhibition, and combinations thereof. Additional beneficial agents that can be added to the fabric cleaning agent described herein include but are not limited to: softening agents such as, e.g., cationic polymers and/or silicones, emulsifiers, enzymes, colorants, bittering agents, and anti-redeposition agents, and combinations thereof.

Additional other benefits which can be provided by the fabric cleaning agent described herein include but are not limited to: anti-wrinkling, odor capturing, fiber protection, color protection, soil releasing, optical brightening, UV protection, anti-pilling, water repellency, disinfecting and/or sanitizing, souring, repellency, and mixtures thereof.

In some aspects, the fabric cleaning agent comprises a solid particulate detergent composition. In some aspects, fabric cleaning agent comprises a surfactant system, sodium carbonate, sodium percarbonate, citric acid, sodium silicate, or any combination thereof. In some aspects, the surfactant system comprises sodium alkyl benzene sulphate and alcohol ethoxylate. In some aspects, the solid particulate detergent composition can comprise: (a) sodium carbonate, (b) sodium percarbonate, (c) sodium alkyl benzene sulphate, (d) C13-15 alcohol ethoxylate (5EO), (d) citric acid anhydrous, (e) C12/13-15 alcohol ethoxylate (7EO), and (f) sodium silicate.

In some aspects, the fabric cleaning agent can have a particle size of from about 50 microns to about 5000 microns, or from about 60 microns to about 4000 microns, or from about 70 microns to about 3500 microns.

In addition to the detergents disclosed herein, various commercially available detergents having a suitable particle size are contemplated for use in the disclosed unit dose article.

In aspects, the fabric cleaning agent of the present disclosure can include some or all of the ingredients listed below.

Detergent(s)

In some aspects, the fabric cleaning agent contains one or more detergents. Detergents, or washing powders, are typically used to clean fabrics and textiles in fabric cleaning methods. In some aspects, the fabric cleaning agent can be a solid, particulate detergent composition.

In some aspects, the detergent can include one or more surfactants. In some aspects, the surfactant(s) can be ionic surfactant(s), i.e., nonionic, cationic, and/or anionic surfactants.

Anionic Surfactants

In some aspects, the fabric cleaning agent comprises at least one anionic surfactant. In some aspects, the fabric cleaning agent comprises 1 to 5, 1 to 4, 1 to 3, 1 to 2, 2 to 5, 2 to 4, 2 to 3, 3 to 5, 3 to 4, or 4 to 5 anionic surfactants. In some aspects, the fabric cleaning agent comprises 1, 2, 3, 4, or 5 anionic surfactants. In some aspects, the fabric cleaning agent comprises 2 anionic surfactants.

Suitable anionic surfactants include but are not limited to those surfactants that contain in their molecular structure a long chain hydrocarbon hydrophobic group and a hydrophilic group, i.e., water solubilizing group including salts such as carboxylate, sulfonate, sulfate, or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group.

In some aspects, the anionic surfactant is a polyethoxylated alcohol sulfate. Such materials, also known as alkyl ether sulfates (AES) or alkyl polyethoxylate sulfates, are those which correspond to formula (I):

$$R^1—O—(C_2H_4O)_n—SO_3M^1 \quad (I)$$

wherein $R^1$ is a $C_8$-$C_{20}$ alkyl group, n is from 1 to 20, and $M^1$ is a salt-forming cation.

In some aspects, le is a $C_{10}$-$C_{18}$ alkyl, n is from 1 to 15, and $M^1$ is sodium, potassium, ammonium, alkylammonium, or alkanolammonium. In some aspects, $R^1$ is a $C_{12}$-$C_{16}$ alkyl, n is from 1 to 6, and $M^1$ is sodium.

In some aspects, the at least one anionic surfactant is an alkyl ether sulfate. In some aspects, the alkyl ether sulfate is sodium lauryl ether sulfate (SLES).

The alkyl ether sulfates will generally be used in the form of mixtures comprising varying $R^1$ chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates can also be added separately to the fabric cleaning agent of this disclosure. Suitable unalkoxylated, e.g., unethoxylated, alkyl ether sulfate surfactants are those produced by the sulfation of higher $C_8$-$C_{20}$ fatty alcohols. Conventional primary alkyl sulfate surfactants have the general formula of: $R^2OSO_3M^2$, wherein $R^2$ is a linear $C_8$-$C_{20}$ hydrocarbyl group, which can be straight chain or branched chain, and $M^2$ is a water-solubilizing cation. In some aspects, $R^2$ is a $C_{10}$-$C_{15}$ alkyl, and $M^2$ is an alkali metal. In some aspects, $R^2$ is a $C_{12}$-$C_{14}$ alkyl and $M^2$ is sodium. Examples of other anionic surfactants are disclosed in U.S. Pat. No. 3,976,586, the disclosure of which is incorporated by reference herein.

In some aspects, the anionic surfactant is a water soluble salt of an alkyl benzene sulfonate having between 8 and 22 carbon atoms in the alkyl group. In some embodiment, the anionic surfactant comprises an alkali metal salt of $C_{10}$-$C_{16}$ alkyl benzene sulfonic acids, such as $C_{11}$-$C_{14}$ alkyl benzene sulfonic acids. In some aspects, the alkyl group is linear and such linear alkyl benzene sulfonates are abbreviated as "LAS." Other suitable anionic surfactants include sodium and potassium linear, straight chain alkylbenzene sulfonates in which the average number of carbon atoms in the alkyl group is between 11 and 14. In some aspects, the anionic surfactant is sodium $C_{11}$-$C_{14}$, e.g., $C_{12}$, LAS.

In some aspects, the anionic surfactant is a α-sulfofatty acid ester. Such a sulfofatty acid is typically formed by esterifying a carboxylic acid with an alkanol and then sulfonating the α-position of the resulting ester. Such materials, known as α-sulfofatty acid ester are those which correspond to formula (II):

$$\begin{array}{l} R^3CHCOOR^4 \\ \quad\;\; | \\ \quad\;\; SO_3R^5 \end{array} \quad (II)$$

wherein $R^3$ is a linear or branched alkyl, $R^4$ is a linear or branched alkyl, and $R^5$ is hydrogen, a halogen, a monovalent or di-valent cation, or an unsubstituted or substituted ammonium cation. In some aspects, $R^3$ is a $C_4$-$C_{24}$ alkyl, including a $C_{10}$, $C_{12}$, $C_{14}$, $C_{16}$, and/or $C_{18}$ alkyl. In some aspects, $R^4$ is a $C_1$-$C_8$ alkyl, including a methyl group. In some aspects, $R^5$ is a mono-valent or di-valent cation, such as a cation that forms a water soluble salt with the α-sulfofatty acid ester (e.g., an alkali metal salt such as sodium, potassium or lithium). In some aspects, the α-sulfofatty acid ester of formula (II) is a methyl ester sulfonate, such as a $C_{16}$ methyl ester sulfonate, a $C_{18}$ methyl ester sulfonate, or a combination thereof. In some aspects, the α-sulfofatty acid ester of formula (II) is a methyl ester sulfonate, such as a mixture of $C_{12}$-$C_{18}$ methyl ester sulfonates.

In some aspects, where the $R^5$ of formula (II) is a monovalent metal, the α-sulfofatty acid ester is of formula (III):

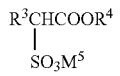

(III)

wherein $R^3$ and $R^4$ are linear or branched alkyls and $M^3$ is a monovalent metal. In some aspects, $R^3$ is a $C_4$-$C_{24}$ alkyl, including a $C_{10}$, $C_{12}$, $C_{14}$, $C_{16}$, and/or $C_{18}$ alkyl. In some aspects, $R^4$ is a $C_1$-$C_8$ alkyl, including a methyl group. In some aspects, $M^3$ is an alkali metal, such as sodium or potassium. In some aspects, the α-sulfofatty acid ester of formula (III) is a sodium methyl ester sulfonate, such as a sodium $C_8$-$C_{18}$ methyl ester sulfonate.

In some aspects, the fabric cleaning agent comprises by weight about 5% to about 50% of at least one anionic surfactant. In some aspects, the fabric cleaning agent comprises by weight about 5% to about 50%, about 5% to about 40%, about 5% to about 30%, about 5% to about 25%, about 5% to about 20%, about 5% to about 10%, about 10% to about 50%, about 10% to about 40%, about 10% to about 30%, about 10% to about 25%, about 10% to about 20%, about 20% to about 50%, about 20% to about 40%, about 20% to about 30%, about 20% to about 25%, about 25% to about 50%, about 25% to about 40%, about 25% to about 30%, about 30% to about 50%, about 30% to about 40%, or about 40% to about 50% of at least one anionic surfactant. In some aspects, the fabric cleaning agent by weight about 25% to about 35% of at least one anionic surfactant.

In some aspects, the fabric cleaning agent of the present disclosure includes a combination of at least one anionic surfactant and at least one nonionic surfactant.

Nonionic Surfactants

In some aspects, the fabric cleaning agent of the present disclosure includes one or more nonionic surfactants. Suitable nonionic surfactants include but are not limited to alkoxylated fatty alcohols, ethylene oxide (EO)-propylene oxide (PO) block polymers, and amine oxide surfactants. Suitable nonionic surfactants for use herein include alcohol alkoxylate nonionic surfactants. Alcohol alkoxylates are materials which correspond to the general formula of: $R^6(C_mH_{2m}O)_pOH$, wherein $R^6$ is a linear or branched $C_8$-$C_{16}$ alkyl group, m is from 2 to 4, and p is from 2 to 12.

In some aspects, $R^6$ is a linear or branched $C_9$-$C_{15}$ or $C_{10}$-$C_{14}$ alkyl group. In some aspects, the alkoxylated fatty alcohols are ethoxylated materials that contain from 2 to 12, or 3 to 10, EO moieties per molecule. The alkoxylated fatty alcohol materials useful in the fabric cleaning agents described herein will frequently have a hydrophilic-lipophilic balance (HLB) which ranges from 3 to 17, from 6 to 15, or from 8 to 15. Alkoxylated fatty alcohol nonionic surfactants have been marketed under the tradenames NEODOL and Dobanol (Shell Chemical Company, Houston, Tex.). Another nonionic surfactant suitable for use includes ethylene oxide (EO)-propylene oxide (PO) block polymers, such as those marketed under the tradename PLURONIC (BASF Corporation, Mount Olive, N.J.). These materials are formed by adding blocks of ethylene oxide moieties to the ends of polypropylene glycol chains to adjust the surface active properties of the resulting block polymers.

In some aspects, the nonionic surfactant is a $C_{12}$-$C_{15}$ alcohol ethoxylate. In some aspects, the nonionic surfactant is $C_{12}$-$C_{15}$ alcohol ethoxylate 7EO. In some aspects, the nonionic surfactant is $C_{12}$-$C_{15}$ alcohol ethoxylate 7EO marketed under the tradename MASODOL 25-7 (Pilot Chemical Corporation, West Chester, Ohio).

Another example of a nonionic surfactant is alkoxylated, preferably ethoxylated or ethoxylated and propoxylated, fatty acid alkyl esters, having from 1 to 4 carbon atoms in the alkyl chain, especially fatty acid methyl esters. In some aspects, the nonionic surfactant is methyl ester ethoxylate.

Suitable nonionic surfactants also include polyalkoxylated alkanolamides, which are generally of the following formula (IV):

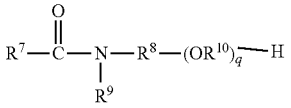

(IV)

wherein $R^7$ is an alkyl or alkoxy, $R^8$ and $R^{10}$ are alkyls, $R^9$ is hydrogen, an alkyl, an alkoxy group, or a polyalkoxylated alkyl, and r is a positive integer.

In some aspects, $R^7$ is an alkyl containing 6 to 22 carbon atoms. In some aspects, $R^8$ is an alkyl containing 1-8 carbon atoms. In some aspects, $R^{10}$ is an alkyl containing 1 to 4 carbon atoms. In some aspects, $R^{10}$ is an ethyl group. The degree of polyalkoxylation (the molar ratio of the oxyalkyl groups per mole of alkanolamide) typically ranges from about 1 to about 100, or from about 3 to about 8, or from about 5 to about 6. In some aspects, the polyalkoxylated alkanolamide is a polyalkoxylated mono- or di-alkanolamide, such as a $C_{16}$ and/or $C_{18}$ ethoxylated monoalkanolamide, or an ethoxylated monoalkanolamide prepared from palm kernel oil or coconut oil.

Other suitable nonionic surfactants include those containing an organic hydrophobic group and a hydrophilic group that is a reaction product of a solubilizing group (such as a carboxylate, hydroxyl, amido, or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Other suitable surfactants include those disclosed in U.S. Pat. Nos. 5,945,394 and 6,046,149, the disclosures of which are incorporated herein by reference. In some aspects, the composition is substantially free of nonylphenol nonionic surfactants. As used herein, the term "substantially free" means less than about one weight percent.

In some aspects, the nonionic surfactant is an amine oxide surfactant. Amine oxides are often referred to in the art as "semi-polar" nonionics, and have the following formula (V):

$$R^{11}(EO)_x(PO)_y(BO)_zN(O)(CH_2R^{12})_2.rH_2O \quad (V)$$

wherein $R^{11}$ is a relatively long-chain hydrocarbyl moiety which can be saturated or unsaturated, linear or branched, and can typically contain from 8 to 20, from 10 to 16 carbon atoms, or a $C_{12}$-$C_{16}$ primary alkyl. $R^{12}$ is a short-chain moiety such as a hydrogen, methyl and —$CH_2OH$. When x+y+z is different from 0, EO is ethyleneoxy, PO is propyleneoxy, and BO is butyleneoxy. r is the number of water molecules in the surfactant. In one embodiment, the nonionic surfactant is $C_2$-$C_{14}$ alkyldimethyl amine oxide.

In some aspects, the fabric cleaning agent comprises by weight about 5% to about 50% of at least one nonionic surfactant. In some aspects, the fabric cleaning agent comprises by weight about 5% to about 50%, about 5% to about 40%, about 5% to about 30%, about 5% to about 25%, about 5% to about 20%, about 5% to about 10%, about 10% to about 50%, about 10% to about 40%, about 10% to about 30%, about 10% to about 25%, about 10% to about 20%, about 20% to about 50%, about 20% to about 40%, about 20% to about 30%, about 20% to about 25%, about 25% to about 50%, about 25% to about 40%, about 25% to about 30%, about 30% to about 50%, about 30% to about 40%, or about 40% to about 50% of at least one nonionic surfactants. In some aspects, the fabric cleaning agent comprises by weight about 25% to about 30% of at least one nonionic surfactant.

Zwitterionic Surfactants

In some aspects, the fabric cleaning agent comprises at least one zwitterionic surfactant. In some aspects, the fabric cleaning agent comprises 1 to 5, 1 to 4, 1 to 3, 1 to 2, 2 to 5, 2 to 4, 2 to 3, 3 to 5, 3 to 4, or 4 to 5 zwitterionic surfactants. In some aspects, the fabric cleaning agent comprises 1, 2, 3, 4, or 5 zwitterionic surfactants. In some aspects, the fabric cleaning agent does not comprise a zwitterionic surfactant.

Suitable zwitterionic surfactants include but not limited to derivatives of secondary and tertiary amines, derivatives of heterocyclic secondary and tertiary amines, or derivatives of quaternary ammonium, quaternary phosphonium or tertiary sulfonium compounds, such as those disclosed in U.S. Pat. No. 3,929,678, which is incorporated by reference herein in its entirety.

In some aspects, the fabric cleaning agent comprises by weight about 1% to about 20% of at least one zwitterionic surfactant. In some aspects, the fabric cleaning agent comprises by weight about 1% to about 20%, about 1% to about 15%, about 1% to about 10%, about 1% to about 5%, about 5% to about 20%, about 5% to about 15%, about 5% to about 10%, about 10% to about 20%, about 10% to about 15%, or about 15% to about 20% of at least one zwitterionic surfactant.

Cationic Surfactants

In some aspects, the fabric cleaning agent comprises at least one cationic surfactant. In some aspects, the fabric cleaning agent comprises 1 to 5, 1 to 4, 1 to 3, 1 to 2, 2 to 5, 2 to 4, 2 to 3, 3 to 5, 3 to 4, or 4 to 5 cationic surfactants. In some aspects, the fabric cleaning agent comprises 1, 2, 3, 4, or 5 cationic surfactants. In some aspects, the fabric cleaning agent does not comprise a cationic surfactant.

Suitable cationic surfactants include but are not limited to quaternary ammonium surfactants. Suitable quaternary ammonium surfactants include mono $C_6$-$C_{16}$, or $C_6$-$C_{10}$ N-alkyl or alkenyl ammonium surfactants, wherein the remaining N positions are substituted by, e.g., methyl, hydroxyethyl or hydroxypropyl groups. Another cationic surfactant is $C_6$-$C_{18}$ alkyl or alkenyl ester of an quaternary ammonium alcohol, such as quaternary chlorine esters. In another embodiment, the cationic surfactants have the following formula (VI):

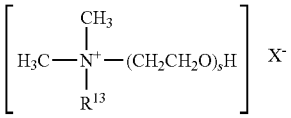

(VI)

wherein $R^{13}$ is $C_8$-$C_{18}$ hydrocarbyl and mixtures thereof, X is an anion such as chloride or bromide, and s is a positive integer. In some aspects, $R^{13}$ is a $C_8$-$C_{14}$ alkyl. In some aspects, $R^{13}$ is a $C_8$ alkyl, a $C_{10}$ alkyl, or a $C_{12}$ alkyl.

In some aspects, the fabric cleaning agent comprises by weight about 1% to about 20% of at least one cationic surfactant. In some aspects, the fabric cleaning agent comprises by weight about 1% to about 20%, about 1% to about 15%, about 1% to about 10%, about 1% to about 5%, about 5% to about 20%, about 5% to about 15%, about 5% to about 10%, about 10% to about 20%, about 10% to about 15%, or about 15% to about 20% of at least one cationic surfactant.

Amphoteric Surfactant

In some aspects, the fabric cleaning agent comprises at least one amphoteric surfactant. In some aspects, the fabric cleaning agent comprises 1 to 5, 1 to 4, 1 to 3, 1 to 2, 2 to 5, 2 to 4, 2 to 3, 3 to 5, 3 to 4, or 4 to 5 amphoteric surfactants. In some aspects, the fabric cleaning agent comprises 1, 2, 3, 4, or 5 amphoteric surfactants. In some aspects, the fabric cleaning agent does not comprise an amphoteric surfactant.

Other suitable surfactants include amphoteric surfactants. Suitable amphoteric surfactants for uses herein include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group.

In some aspects, the fabric cleaning agent comprises by weight about 1% to about 20% of at least one amphoteric surfactant. In some aspects, the fabric cleaning agent comprises by weight about 1% to about 20%, about 1% to about 15%, about 1% to about 10%, about 1% to about 5%, about 5% to about 20%, about 5% to about 15%, about 5% to about 10%, about 10% to about 20%, about 10% to about 15%, or about 15% to about 20% of at least one amphoteric surfactant.

In some aspects, the surfactant can be present in the fabric cleaning agent at a concentration of from about 0% to about 60%, or from about 5% to about 50% percent, or from about 10% to about 30% percent, or from about 20% to about 40%, based on the weight of the fabric cleaning agent.

Additional Benefit Agents

In some aspects, the composition of the present disclosure can comprise some or all of the ingredients listed below.

Fragrance(s)

In some aspects, the fabric cleaning agent contains one or more fragrances.

In some aspects, the fragrance is a neat fragrance (i.e., a free oil), or an encapsulated fragrance (e.g. melamine-formaldehyde encapsulates). In some aspects, the fragrance is an ester, an ether, an aldehyde, a ketone, an alcohol, a hydrocarbon, an oil, an essential oil, a botanical, or any combination thereof.

In some aspects, the fragrance can be an ester, an ether, an aldehyde, a ketone, an alcohol, a hydrocarbon, an essential oil, and a combination thereof.

In some aspects, the fragrance can be, for example, adoxal (2,6,10-trimethyl-9-undecenal), anisaldehyde (4-methoxybenzaldehyde), cymal (3-(4-isopropyl-phenyl)-2-methylpropanal), ethylvanillin, florhydral (3-(3-isopropylphenyl) butanal), helional (3-(3,4-methylenedioxyphenyl)-2-methylpropanal), heliotropin, hydroxycitronellal, lauraldehyde, lyral (3- and 4-(4-hydroxy-4-methylpentyl)-3-cyclohexene-1-carboxaldehyde), methyl nonyl acetaldehyde, lilial (3-(4-tert-butylphenyl)-2-methylpropanal), phenyl acetaldehyde, undecylenaldehyde, vanillin, 2,6,10-trimethyl-9-undecenal, 3-dodecen-1-al, alpha-n-amylcinnamaldehyde, melonal (2,6-dimethyl-5-heptenal), 2,4-dimethyl-3-cyclohexene-1-carboxaldehyde (triplal), 4-methoxybenzaldehyde, benzaldehyde, 3-(4-tert-butylphenyl)propanal, 2-methyl-3-(para-methoxyphenyl)propanal, 2-methyl-4-(2,6,6-timethyl-2(1)-cyclohexen-1-yl)butanal, 3-phenyl-2-propenal, cis-/trans-3,7-dimethyl-2,6-octadien-1-al, 3,7-dimethyl-6-octen-1-al, [(3,7-dimethyl-6-octenyl)oxy]acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo[5.2.1.0(2,6)]decylidene-8)butanal, octahydro-4,7-methano-1H-indenecarboxaldehyde, 3-ethoxy-4-hydroxybenzaldehyde, para-ethyl-alpha,alpha-dimethylhydrocinnamaldehyde, alpha-methyl-3,4-(methylenedioxy)hydrocinnamaldehyde, 3,4-methylenedioxybenzaldehyde, alpha-n-hexylcinnamaldehyde, m-cymene-7-carboxaldehyde, alpha-methyl phenylacetaldehyde, 7-hydroxy-3,7-dimethyloctanal, undecanal, 2,4,6-trimethyl-3-cyclohexene-1-carboxaldehyde, 4-(3)(4-methyl-3-pentenyl)-3-cyclohexenecarboxaldehyde, 1-dodecanal, 2,4-dimethylcyclohexene-3-carboxaldehyde, 4-(4-hydroxy-4-methylpentyl)-3-cylohexene-1-carboxaldehyde, 7-methoxy-3,7-dimethyloctan-1-al, 2-methylundecanal, 2-methyldecanal, 1-nonanal, 1-octanal, 2,6,10-trimethyl-5,9-undecadienal, 2-methyl-3-(4-tert-butyl)propanal, dihydrocinnamaldehyde, 1-methyl-4-(4-methyl-3-pentenyl)-3-cyclohexene-1-carboxaldehyde, 5- or 6-methoxyhexahydro-4,7-methanoindane-1- or -2-carboxaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxaldehyde, 7-hydroxy-3J-dimethyloctanal, trans-4-decenal, 2,6-nonadienal, para-tolylacetaldehyde, 4-methylphenylacetaldehyde, 2-methyl-4-(2,6,6-trimethyl-1-cyclohexen-1-yl)-2-butenal, ortho-methoxycinnamaldehyde, 3,5,6-trimethyl-3-cyclohexenecarboxaldehyde, 3J-dimethyl-2-methylene-6-octenal, phenoxyacetaldehyde, 5,9-dimethyl-4,8-decadienal, peony aldehyde (6,10-dimethyl-3-oxa-5,9-undecadien-1-al), hexahydro-4,7-methanoindane-1-carboxaldehyde, 2-methyloctanal, alpha-methyl-4-(1-methylethyl)benzene acetaldehyde, 6,6-dimethyl-2-norpinene-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propyl-bicyclo-[2.2.1]-hept-5-ene-2-carbaldehyde, 9-decenal, 3-methyl-5-phenyl-1-pentanal, methyl nonyl acetaldehyde, hexanal and trans-2-hexenal.

In some aspects, the fragrance can be, for example, methyl beta-naphthyl ketone, musk indanone (1,2,3,5,6,7-hexahydro-1,1,2,3,3-pentamethyl-4H-inden-4-one), tonalide (6-acetyl-1,1,2,4,4,7-hexamethyltetralin), alpha-damascone, beta-damascone, delta-damascone, iso-damascone, damascenone, methyl dihydrojasmonate, menthone, carvone, camphor, koavone (3,4,5,6,6-pentamethylhept-3-en-2-one), fenchone, alpha-ionone, beta-ionone, gamma-methyl ionone, fleuramone (2-heptylcyclopentanone), dihydrojasmone, cis-jasmone, Iso E Super (1-(1,2,3,4,5,6J,8-octahydro-2,3,8,8-tetramethyl-2-naphthalenyl)ethan-1-one (and isomers)), methyl cedrenyl ketone, acetophenone, methyl acetophenone, para-methoxyacetophenone, methyl beta-naphtyl ketone, benzyl acetone, benzophenone, para-hydroxyphenylbutanone, celery ketone (3-methyl-5-propyl-2-cyclohexenone), 6-isopropyldecahydro-2-naphtone, dimethyl octenone, frescomenthe (2-butan-2-ylcyclohexan-1-one), 4-(1-ethoxyvinyl)-3,3,5,5-tetramethylcyclohexanone, methyl heptenone, 2-(2-(4-methyl-3-cyclohexen-1-yl)propyl)cyclopentanone, 1-(p-menthen-6(2)yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)indanone, 4-damascol, dulcinyl(4-(1,3-benzodioxol-5-yl)butan-2-one), Hexalon (1-(2,6,6-trimethyl-2-cyclohexen-1-yl)-1,6-heptadien-3-one), isocyclemone E (2-acetonaphthone-1,2,3,4,5,6,7,8-octahydro-2,3,8,8-tetramethyl), methyl nonyl ketone, methyl cyclocitrone, methyl lavender ketone, orivone (4-tert-amylcyclohexanone), 4-tert-butylcyclohexanone, delphone (2-pentyl cyclopentanone), muscone (CAS 541-91-3), neobutenone (1-(5,5-dimethyl-1-cyclohexenyl)pent-4-en-1-one), plicatone (CAS 41724-19-0), veloutone (2,2,5-trimethyl-5-pentylcyclopentan-1-one), 2,4,4,7-tetramethyloct-6-en-3-one and tetrameran (6,10-dimethylundecen-2-one).

In some aspects, the fragrance can be, for example, 10-undecen-1-ol, 2,6-dimethylheptan-2-ol, 2-methylbutanol, 2-methylpentanol, 2-phenoxyethanol, 2-phenylpropanol, 2-tert-butylcyclohexanol, 3,5,5-trimethylcyclohexanol, 3-hexanol, 3-methyl-5-phenylpentanol, 3-octanol, 3-phenylpropanol, 4-heptenol, 4-isopropylcyclohexanol, 4-tert-butylcyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-menthan-7-ol, phenylethyl alcohol, phenol, phenyl salicylat, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

In some aspects, the fragrance can be, for example, for example, benzyl acetate, phenoxyethyl isobutyrate, p-tert-butylcyclohexyl acetate, linalyl acetate, dimethyl benzyl carbinyl acetate (DMBCA), phenyl ethyl acetate, benzyl acetate, ethylmethylphenyl glycinate, allyl cyclohexyl propionate, styralyl propionate, benzyl salicylate, cyclohexyl salicylate, floramat, melusat and jasmacyclat.

In one embodiment, the fragrance can be, for example, for example, benzyl ethyl ether and ambroxan. The hydrocarbons include mainly terpenes, such as limonene and pinene.

In some aspects, the fragrance can be mixtures of various fragrances, which can be referred to as a perfume or perfume oil. Perfume oils of this kind can also contain natural fragrance mixtures, as are obtainable from plant sources.

In some aspects, the fragrance can be, for example, essential oils such as angelica root oil, anise oil, arnica blossom oil, basil oil, bay oil, champaca blossom oil, citrus oil, silver fir oil, silver fir cone oil, elemi oil, eucalyptus oil, fennel oil, pine needle oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, canaga oil, cardamom oil, cassia oil, pine needle oil, copaiba balsam oil, coriander oil, spearmint oil, caraway oil, cumin oil, labdanum oil, lavender oil, lemongrass oil, lime blossom oil, lime oil, mandarin oil, balm oil, mint oil, musk seed oil, muscatel oil, myrrh oil, clove oil, neroli oil, niaouli oil, olibanum oil, orange blossom oil, orange oil, origanum oil, palmarosa oil, patchouli oil, peru balsam oil, petitgrain oil, pepper oil, peppermint oil, pimento oil, pine oil, rose oil, rosemary oil, sage oil, sandalwood oil, celery oil, spike oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil and ambrettolide, ambroxan, alpha-amylcinnamaldehyde, anethol, anisaldehyde, anise alcohol, anisol, anthranilic acid methyl ester, acetophenone, benzyl acetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptine carboxylic acid methyl ester, heptaldehyde, hydroquinone dimethyl ether, hydroxycinnamaldehyde, hydroxycinnamyl alcohol, indol, irone, isoeugenol, isoeugenol methyl ether, isosafrole, jasmone, camphor, carvacrol, carvone, p-cresol methyl ether, cumarin, p-methoxyacetophenone, methyl n-amyl ketone, methyl anthranilic acid methyl ester, p-methyl acetophenone, methyl chavicol, p-methyl quinoline, methyl beta-naphthyl ketone, methyl n-nonyl acetaldehyde, methyl n-nonyl ketone, muscone, beta-naphthol ethyl ether, beta-naphthol methyl ether, nerol, n-nonyl aldehyde, nonyl alcohol, n-octyl aldehyde, p-oxy-acetophenone, pentadecanolide, beta-phenyl ethyl alcohol, phenyl acetic acid, pulegone, safrole, salicylic acid isoamyl ester, salicylic acid methyl ester, salicylic acid hexyl ester, salicylic acid cyclohexyl ester, santalol, sandelice, skatole, terpineol, thymene, thymol, troenan, gamma-undelactone, vanillin, veratrum aldehyde, cinnmaldehyde, cinnamyl alcohol, cinnamic acid, cinnamic acid ethyl ester, cinnamic acid benzyl ester, diphenyl oxide, limonene, linalool, linalyl acetate and propionate, melusat, menthol, menthone, methyl n-heptenone, pinene, phenyl acetaldehyde, terpinyl acetate, citral, citronellal, and mixtures thereof.

In some aspects, the fragrance can have, for example, a musky scent, a pungent scent, a camphoraceous scent, an ethereal scent, a floral scent, a peppermint scent, or any combination thereof.

In some aspects, the fragrance can be methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

In some aspects, the fragrance can be a linear terpene, a cyclic terpene, an aromatic compound, a lactone, a thiol, or any combination thereof.

In some aspects, any fragrance commercially available from a fragrance supplier (for example, Firmenich, Givaudan, International Flavors and Fragrances (IFF), Oriental etc.), or combinations of such fragrances, can also suitably be used in the fabric cleaning agents and methods disclosed herein.

In some aspects, the fragrance can be a fragrance precursor. "Fragrance precursor" refers to compounds which only release the actual fragrance following chemical conversion/separation, for example, when exposed to light or other environmental conditions, such as pH, temperature, etc. Cleaning agents of this kind are often referred to as pro-fragrances.

In some aspects, at least some of the fragrance can be encapsulated, for example, in a microcapsule or a nanocapsule. The microcapsules and nanocapsules can be water-soluble or water-insoluble. In one embodiment, all of the fragrance is encapsulated. Examples of encapsulated fragrances are described in, for example, U.S. Pat. Nos. 6,024,943, 6,056,949, 6,194,375, 6,458,754 and 8,426,353, and US 2011/0224127 A1, each of which is incorporated by reference in its entirety.

In some aspects, the fragrance is present in the cleaning agent from about 0.1% to about 10%, or from about 0.5 wt % to about 10.0 wt %, or from about 0.5 wt % to about 8.0 wt %, or from about 0.5 wt % to about 7.5 wt %, or from about 0.5 wt % to about 5.0 wt %, based on the total weight of the fabric cleaning agent.

Enzyme(s)

In some aspects, the composition of the present disclosure further comprises one or more enzymes. Suitable enzymes include one or more of mannanases, proteases, amylases, lipases, and cellulases.

Anti-Redeposition Agent(s)

Anti-redeposition agents are typically used to keep soil dispersed in the wash water of a washing machine, thereby preventing soil from re-depositing onto the fabrics being laundered.

In some aspects, the the composition of the present disclosure can include at least one anti-redeposition agent. Suitable anti-redeposition agents include but are not limited to: polyacrylate, polymethylacrylate, methylacrylate styrene copolymers, sodium methylacrylate styrene copolymers, and mixtures thereof. In some aspects, suitable anti-redeposition agents include homopolymers of acrylic acid.

Kit(s) Comprising the Unit Dose Article(s)

In some aspects, the present disclosure provides kits comprising one or more unit doses, for example one or more of the unit doses described herein. In some aspects, the unit doses each comprise a polyester receptacle enclosing a cavity containing a solid fabric cleaning agent disposed within the cavity of the polyester receptacle. Various shapes and sizes of the unit doses are contemplated. In some aspects, the kits comprise unit doses that are sealed with an adhesive binding. In some aspects, the kits comprise unit doses that are sealed with liquid-soluble stitches. In some aspects, the kits comprise instructions for use. For example, instructions indicating preferred wash cycle temperatures (i.e., cold, warm, or hot water cycles) are contemplated.

Method of Making and Using the Unit Dose Article(s)

The present disclosure also provides methods of making unit doses for treating fabrics in a washing machine and dryer. In some aspects, a method of making a unit dose for treating fabrics comprises providing a polyester receptacle, wherein the polyester receptacle comprises a plurality of pores permeable to liquid such that the polyester receptacle allows liquid to diffuse into and out of the cavity, wherein the polyester receptacle is coated with a softening agent, shaping the polyester receptacle to define a cavity, disposing a solid fabric cleaning agent within the cavity of the polyester receptacle, and sealing the polyester receptacle to enclose the solid fabric treatment agent. Suitable softening agents are described herein. In some aspects, the sealing step is conducted by use of a plurality of liquid-soluble stitches to releasably seal the cavity, such that the polyester receptacle is configured to unseal and release the fabric cleaning agent when immersed in liquid.

Suitable solid fabric cleaning agents include any of the fabric cleaning agents described herein, or the commercially available solid fabric cleaning agents disclosed herein. In some aspects, the polyester receptacle can be provided by any suitable process, such as, for example, molding, casting, extruding, or blowing a sheet of polyester material. In some aspects, the polyester receptacle can be securely sealed by any suitable process, such as, for example, applying heat, applying an adhesive binding or using a mechanical fastener (e.g., stitches).

Methods of treating one or more fabrics in a washing machine and a dryer, for example, a method of cleaning fabrics with a detergent in the washing machine, and imparting softness when the treated fabric is dried in the dryer are also provided. In some aspects, a method for treating one or more fabrics in a washing machine and a dryer, includes: (i) disposing the unit dose of the present disclosure and fabrics to be cleaned in the washing machine, (ii) setting the washing machine on a wash cycle to immerse the fabrics and the unit dose in liquid and wash the fabrics, wherein during the wash cycle the fabric cleaning agent is dissolved and carried out of the cavity for cleaning the fabrics, (iii) removing the fabrics with the polyester receptacle from the washing machine; (iv) disposing the fabrics and the polyester receptacle into a dryer; and (v) setting the dryer on a heated drying cycle to apply heat to the fabrics with the polyester receptacle, wherein during the drying cycle the softening agent is consumed for providing a softening effect onto the fabrics.

Additional beneficial agents for inclusion in the fabric cleaning agent are also contemplated.

Figure 5:
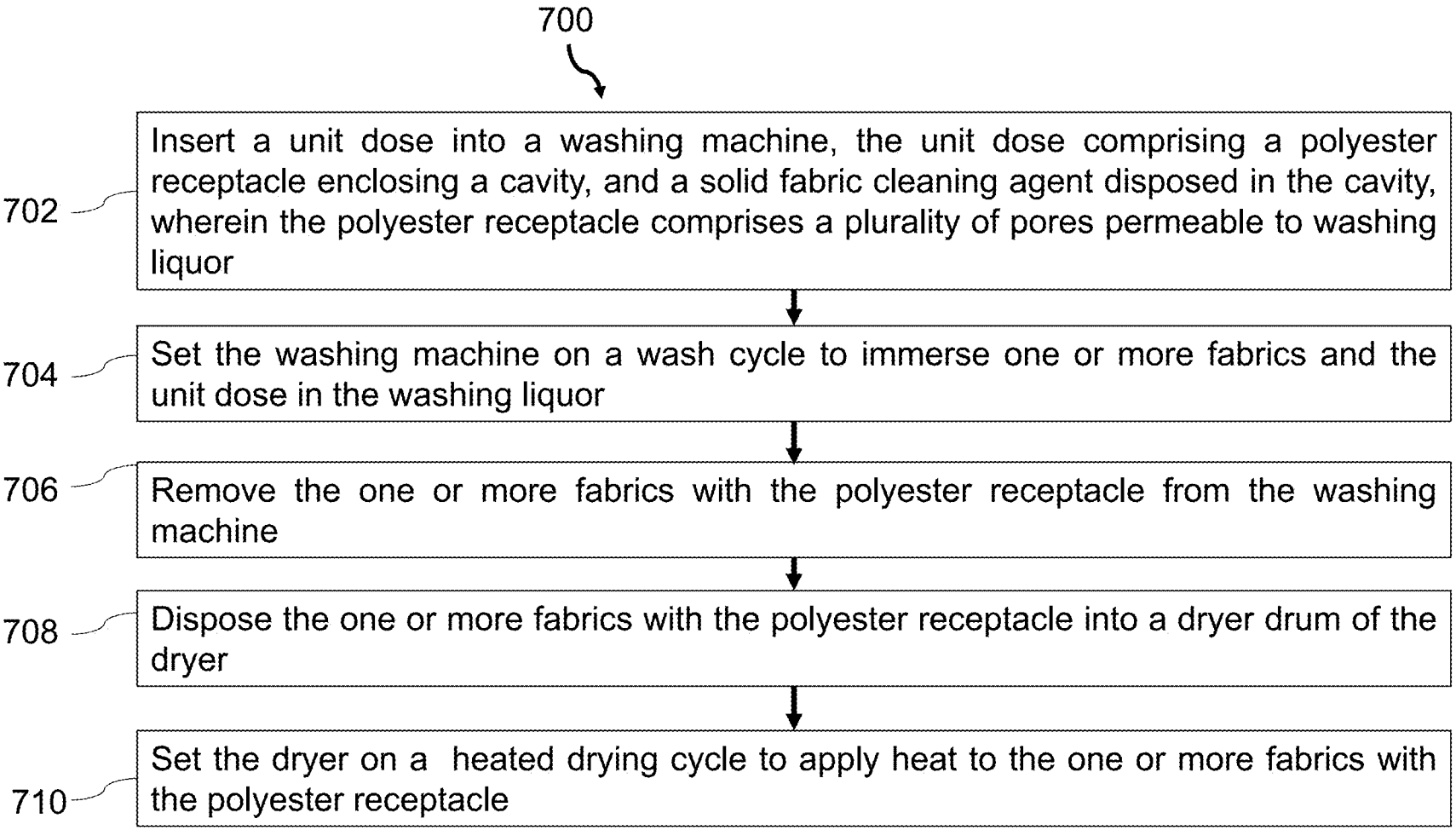
FIG. 5 illustrates a flow chart for a method of using a unit dose to treat laundry, according to an embodiment.

In some aspects, as shown in FIG. 5, a method 700 of treating one or more fabrics in a washing machine and a dryer comprises a step 702 of inserting a unit dose as disclosed herein into the washing machine. In some aspects, the unit dose comprises a polyester receptacle enclosing a cavity which contains a solid fabric cleaning agent, wherein the polyester receptacle comprises a plurality of pores permeable to liquid, i.e., the washing liquor, such that the polyester receptacle allows the liquid, i.e., the washing liquor to diffuse into and out of the cavity through the pores and dissolve the fabric cleaning agent, and carry dissolved fabric cleaning agent out of the cavity. In some aspects, the exterior surface and interior surface of the polyester receptacle are coated with a softening agent.

In some aspects, the method 700 comprises a step 704 of setting the washing machine on a wash cycle to immerse the one or more fabrics and the unit dose in the washing liquor, thereby allowing the washing liquor in the washing machine to dissolve the solid fabric cleaning agent within the unit dose. In some aspects, step 704 further comprises setting the washing liquor at a predetermined temperature, wherein the temperature of the washing liquor is lower than the melting point of the softening agent coated on the polyester receptacle. While the fabric cleaning agent is dissolved in the washing liquor, the softening agent coated remains applied to the exterior and interior surfaces of the polyester receptacle.

In some aspects, the method 700 comprises a step 706 of removing the one or more fabrics with the polyester receptacle from the washing machine. In some aspects, the method 700 comprises a step 708 of disposing the one or more fabrics with the polyester receptacle into a dryer drum of the dryer. As the polyester receptacle is transported with the one or more articles of clothing during steps 706 and 708, the softening agent remains applied to the interior and exterior surfaces of the polyester receptacle.

In some aspects, the method 700 can comprise a step 710 of setting the dryer on a heated drying cycle to apply heat to the one or more fabrics with the polyester receptacle. In some aspects, the applied heat raises the temperature of the polyester receptacle above the melting temperature of the softening agent. In some aspects, the applied heat of the heated drying cycle melts the softening agent, such that the softening agent is freed from the polyester receptacle and can deposit onto the one or more fabrics tumbling in the dryer.

While the unit dose described herein can treat one or more fabrics through the use of a washing machine and a dryer, the unit dose can treat one or more fabrics with any suitable device or combination of devices that is capable of: (i) immersing the unit dose with the one or more fabrics in a liquid to dissolve the fabric cleaning agent disposed in the cavity of the polyester receptacle; (ii) separating the one or more fabrics with the polyester receptacle from the liquid bath such that the one or more fabrics and the polyester receptacle are exposed to a dry setting; and (iii) applying heat to the one or more fabrics and the polyester receptacle such that the softening agent is freed from the surfaces of the polyester receptacle and deposited on the one or more fabrics.

EXAMPLE

A softening test was designed to assess the softening performance of the unit dose of the present disclosure.

A fabric softening sheet was used to prepare a polyester receptacle according to the following formulation:

TABLE 1

| Material | % Active | % In Formula |
|---|---|---|
| BLK Polyester sheet | 100.00% | 35.0 |
| Stepantex HTS-100 (cationic surfactant) | 100.00% | 65.0 |
| | Total | 100.00 |

Specifically, Stepantex HTS-100 (Stepan, Northfield, Ill.), i.e., methyl bis[ethyl (tallowate)]-2-hydroxyethyl ammonium methyl sulfate, a cationic surfactant, was used to coat a polyester sheet. About 1.3 grams of sheet were used to encapsulate the detergent powder. The sheet was then formed into a polyester receptacle in the shape of a rectangle, with a cavity for disposal of a detergent. About 30 grams of commercially available particulate powder laundry detergent was enclosed in the coated polyester sheet, which was sealed with glue, to form a prototype unit dose (FIG. 6).

A laundry cleaning method using the unit dose prototype described above was tested in three experiments. The samples used in the experiments are set forth in Table 2, and further described below.

TABLE 2

| | Material added to Wash | Material added to Dryer |
|---|---|---|
| Comparative Sample 1 | 30 grams of powder detergent | No fabric softening sheet |
| Comparative Sample 2 | 30 grams of powder detergent (no fabric softening sheet) | 1.3 g Fabric softening sheet (FSS) |
| 2-in-1 Unit Dose Prototype | 30 grams of powder detergent encapsulated in 1.3 grams of fabric softening sheet | Residual FSS from wash |

In each experiment, about six pounds of cotton ballast was used to simulate a load of consumer laundry. The ballast was run through three washing cycles in a standard top loading washing machine (90° F. wash water, 120 ppm hardness, 0 ppm chlorine). The ballasts were dried on regular heat in a standard top loading tumble dryer. In the first experiment, about 30 grams of loose detergent was added to the ballast before the start of the washing cycle. The wet, cleaned ballast was dried in a tumble dryer without the addition of any additional agents. In the second experiment, about 30 grams of loose detergent was added to the ballast before the start of the washing cycle. The wet cleaned ballast was added to the dryer along with a dryer sheet (1.3 grams of fabric softening agent). The wet, cleaned ballast was then dried in a tumble dryer with the dryer sheet. In the third experiment, the prototype unit dose described above was placed into the washing machine with the ballast before starting the washing cycle. The unit dose was carried into the dryer with the wet ballast and the dryer was turned on a normal heated dry cycle. Following drying, fabric samples from each experiment were subjected to softness testing.

Softness can be described as "feel performance." Feel performance can be characterized using the Extraction Energy Test Method (EETM), using a Phabrometer instrument (Nu Cybertek, Davis, Ca). Following drying, fabric samples from each group were tested with a Phabrometer. The results are shown in Table 2 below in descending order of the resulting softness from softest to harshest.

TABLE 3

| Experiment | Level | Softness Score |
|---|---|---|
| 2-in-1 Unit Dose Prototype | A | 90.500900 |
| Detergent (washer) + fabric softener sheet (added separately in dryer) | B | 89.883463 |
| Detergent only | C | 89.350275 |

The first column provides the experimental protocol. The second column indicates the statistical category of the fabric sample. Levels not connected by the same letter are significantly different. The third column provides the softness score of the sample fabric as measured by the Phabrometer. A higher softness score indicates a softer sample. The average scores of each of the three experiments were combined to provide the scores listed in Table 2.

The results showed that after 3 washes, the unit dose had a softness value of 90.5, which was statistically different than the detergent plus the fabric softener sheet added separately in the dryer (89.9 value). This result was surprising because it was unexpected that the unit dose would provide an advantageous significant difference in softness over the detergent plus the fabric softener sheet added separately in the dryer, because the unit dose was formulated as a convenient and environmental benefit to the consumer and not for providing an additional softening benefit. The test fabrics that were dried with softening agents (unit dose and fabric softener sheet) were statistically better than detergent alone (89.3 value).

This example demonstrates that the addition of the 2-in-1 unit dose of the present disclosure to a load of sample fabrics in a washing machine provided a significant beneficial softening impact to the fabric samples.

It will be understood by those of ordinary skill in the art that the same can be performed within a wide and equivalent range of conditions, formulations and other parameters without affecting the scope of the disclosure or any embodiment thereof. All patents, patent applications, and publications cited herein are fully incorporated by reference herein in their entirety.

The foregoing description of the specific aspects has revealed the general nature of the disclosure such that others can, by applying knowledge within the skill of the art, readily modify and/or adapt for various applications such specific aspects, without undue experimentation, without departing from the general concept of the present disclosure. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed:

1. A unit dose for laundering fabrics, comprising:
a polyester receptacle enclosing a cavity;
a fabric cleaning agent disposed within the cavity of the polyester receptacle, and
a softening agent coated on the polyester receptacle,
wherein the polyester receptacle comprises a plurality of pores permeable to liquid such that upon contacting the unit dose with a liquid, the polyester receptacle allows liquid to diffuse into and out of the cavity through the pores, dissolve the fabric cleaning agent, and carry dissolved fabric cleaning agent out of the cavity.

2. The unit dose of claim 1, wherein the polyester receptacle comprises an adhesive binding sealing the polyester receptacle, wherein the fabric cleaning agent disposed within the cavity is bound within the polyester receptacle such that the fabric cleaning agent dissolves within the polyester receptacle during a wash cycle in a washing machine, and the polyester receptacle remains sealed throughout the duration of the wash cycle.

3. The unit dose of claim 1, wherein the polyester receptacle comprises a plurality of liquid-soluble stitches releasably sealing the cavity, wherein the polyester receptacle is configured to unseal and release the fabric cleaning agent when immersed in liquid.

4. The unit dose of claim 1, wherein the polyester receptacle is spherical-shaped or cubical-shaped.

5. The unit dose of claim 1, wherein the polyester receptacle is configured to enclose from about 5 grams to about 100 grams of the fabric cleaning agent within the cavity, and wherein a portion of the cavity is free of the fabric cleaning agent.

6. The unit dose of claim 1, wherein the plurality of pores have a transverse dimension configured to enclose a fabric cleaning agent having a particle size that is larger than about 50 microns.

7. The unit dose of claim 6, wherein the fabric cleaning agent has a particle size of from about 50 microns to about 5000 microns, or from about 60 microns to about 4000 microns, or from about 70 microns to about 3500 microns.

8. The unit dose of claim 1, wherein the fabric cleaning agent comprises a solid particulate detergent composition.

9. The unit dose of claim 8, wherein the fabric cleaning agent comprises a surfactant system, sodium carbonate, sodium percarbonate, citric acid, sodium silicate, or any combination thereof.

10. The unit dose of claim 9, wherein the surfactant system comprises sodium alkyl benzene sulphate and alcohol ethoxylate.

11. The unit dose of claim 1, wherein the fabric cleaning agent further comprises a fragrance, or a dye transfer inhibitor, or both.

12. The unit dose of claim 11, wherein the fabric cleaning agent further comprises at least one additional agent selected from the group consisting of: an anti-wrinkling agent, an odor capturing agent, a fiber protection agent, a color protection agent, a soil releasing agent, an optical brightening agent, a UV protection agent, an anti-pilling agent, a water repellency agent, a disinfecting, a sanitizing agent, a souring agent, a repellent, and mixtures thereof.

13. The unit dose of claim 1, wherein the softening agent adheres to the polyester receptacle throughout a wash cycle in a washing machine.

14. The unit dose of claim 13, wherein the softening agent comprises a quaternary ammonium compound.

15. The unit dose of claim 14, wherein the quaternary ammonium compound is selected from the group consisting of: alkylated quaternary ammonium compounds, ring or cyclic quaternary ammonium compounds, aromatic quaternary ammonium compounds, diquatemary ammonium compounds, alkoxylated quaternary ammonium compounds, amidoamine quaternary ammonium compounds, ester quaternary ammonium compounds, and mixtures thereof.

16. The unit dose of claim 15, wherein the softening agent is present in an amount of from about 35 to 80%, by a combined weight of the polyester receptacle and the softening agent.

17. The unit dose of claim 16, wherein the softening agent has a melting point of from about 80° F. to about 150° F.

18. A method of making a unit dose for treating fabrics in a washing machine and a dryer, comprising:

providing a polyester receptacle, wherein the polyester receptacle comprises a plurality of pores permeable to liquid such that, upon contacting the unit dose with a liquid, the polyester receptacle allows liquid to diffuse into and out of the cavity, wherein the polyester receptable is coated with a softening agent, shaping the polyester receptable to define a cavity, disposing a solid fabric treatment agent within the cavity of the polyester receptacle, and sealing the polyester receptacle to enclose the solid fabric treatment agent.

19. The method of claim 18, wherein the sealing step is conducted by use of a plurality of liquid-soluble stitches to releasably seal the cavity, such that the polyester receptacle is configured to unseal and release the fabric cleaning agent when immersed in liquid.

20. A method of treating laundry in a washing machine and a dryer, comprising:

(i) disposing the unit dose of claim 1 and fabrics to be cleaned in the washing machine, (ii) setting the washing machine on a wash cycle to immerse the fabrics and the unit dose in liquid and wash the fabrics, wherein during the wash cycle the fabric cleaning agent is dissolved and carried out of the cavity for cleaning the fabrics, (iii) removing the fabrics with the polyester receptacle from the washing machine;

(iv) disposing the fabrics and the polyester receptacle into a dryer; and (v) setting the dryer on a heated drying cycle to apply heat to the fabrics with the polyester receptacle, wherein during the drying cycle the softening agent is consumed for providing a softening effect onto the fabrics.

* * * * *